US007497713B1

(12) United States Patent
Huettner et al.

(10) Patent No.: US 7,497,713 B1
(45) Date of Patent: Mar. 3, 2009

(54) AUTOMATICALLY ADJUSTABLE CONNECTOR TO ACCOMMODATE CIRCUIT BOARD OF VARYING THICKNESS

(75) Inventors: Cary Michael Huettner, Rochester, MN (US); Joseph Kuczynski, Rochester, MN (US); Robert Ernest Meyer, III, Rochester, MN (US); Mark David Plucinski, Rochester, MN (US); Timothy Jerome Tofil, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/142,571

(22) Filed: Jun. 19, 2008

(51) Int. Cl.
*H01R 13/15* (2006.01)
*H01R 13/62* (2006.01)

(52) U.S. Cl. ..... 439/265; 439/635

(58) Field of Classification Search ..... 439/265, 439/267, 635
See application file for complete search history.

(56) References Cited

U.S. PATENT DOCUMENTS 4,077,688 A * 3/1978 Cobaugh et al. ..... 439/267
5,171,154 A * 12/1992 Casciotti et al. ..... 439/67
6,036,519 A * 3/2000 Lopata et al. ..... 439/260
6,095,821 A 8/2000 Panella et al.
6,213,804 B1 * 4/2001 Matsumura ..... 439/267
6,254,435 B1 7/2001 Cheong et al.
6,790,054 B1 9/2004 Boonsue
6,976,879 B2 12/2005 Shishikura et al.
6,979,216 B2 * 12/2005 Maeda et al. ..... 439/260
7,033,222 B2 4/2006 Kitamura
7,192,287 B2 3/2007 Kikuchi et al.
7,338,303 B1 * 3/2008 Yi et al. ..... 439/267
2005/0003711 A1 1/2005 Chang
2005/0186820 A1 * 8/2005 Maeda et al. ..... 439/260

* cited by examiner

*Primary Examiner*—Hae Moon Hyeon
(74) *Attorney, Agent, or Firm*—Patent Analysis Research Tech. Sys. LLC; George L. Walton

(57) ABSTRACT

A card edge connector assembly with a housing with side walls and a housing base portion embodying an unique card edge auto thickness detection mechanism that includes a pair of movable block members with interconnected upstanding auto thickness detection members and contact pins, a pair of spring members positioned between the movable blocks and interior wall portions of the housing and a pair of stabilizing tie rod members cooperatively associated with the movable blocks for allowing translational movement, while preventing rotation. Each movable block having an extending projection slidably received within longitudinal channels formed in the base housing portion for maintaining the auto thickness detection mechanism in a selected position. Upon insertion of PCI cards between the contact pins and the auto thickness detection members, the contact pins and the auto thickness detection members are moved away from one another against the spring members for accommodating card edges of varying thicknesses.

1 Claim, 4 Drawing Sheets

AUTOMATICALLY ADJUSTABLE CONNECTOR TO ACCOMMODATE CIRCUIT BOARD OF VARYING THICKNESS

BACKGROUND OF THE INVENTION

1. Field of the Invention

The present invention relates to the field of electrical connectors, more specifically defined as card edge connectors or card-receiving devices used in but not limited to the computer industry. More specifically, the invention relates to Peripheral Component Interconnect (PCI) connectors. The PCI standard specifies a computer bus for attaching peripheral devices to a computer motherboard. These devices can either take the form of an integrated circuit fitted onto the motherboard itself (known as a planar device) or an expansion card that fits into a socket or connector. The PCI bus is the most common expansion bus in modern PCs but it also appears in many other computer types. The PCI specification covers the physical size of the bus (including wire spacing), electrical characteristics, bus timing, and protocols. Typical PCI cards used in PCs include: network cards, sound cards, modems, extra ports such as USB or serial, TV tuner cards and disk controllers. Depending on the desired complexity and functionality of the card, the thickness of the PCI card may vary from the nominal value documented in the specification to a value that exceeds that value. Since PCI connectors are fabricated based on the nominal tolerance range in the specification, highly complex cards cannot be accommodated by standard PCI connectors. Hence, there exists a need in the industry for a universally adaptable PCI connector that can accept PCI card thicknesses that exceed the thickness outlined in the PCI specification.

2. Description of the Related Art

It is well known today that various types of cards having different functional purposes (for example, network cards, sound cards, modems, extra ports such as USB or serial, TV tuner cards and disk controllers), different shapes, and different dimensions are in widespread use. To improve their usability, these cards are manufactured to an existing PCI standard that defines the physical card dimensions. Unfortunately, as card complexity increases, card thickness also increases, often to the point where the PCI specification is violated. In order for a system designer to use such a card, a custom connector would be required which is most often cost prohibitive.

This invention relates to a contact edge card connector engineered to facilitate perpendicular PCI card mating in space-critical applications. These card edge connectors are a type of electrical connector widely used in the electronics industry. A card edge connector receives a printed circuit board (PCB), typically a PCI card, having a mating edge and a plurality of contact pads adjacent to the edge. Such edge connectors have an elongated housing defining an elongated receptacle or slot for receiving the mating edge of the board. The PCI connector pins are generally in pairs for engaging the contact pads on opposite sides of the PCI card. The mating edge board or card is commonly called the "daughter" board, and the board to which the connector is mounted is commonly called the "mother" board. Often there is limited room above the PCB to mount the conventional card edge connector to the motherboard making a right angle mounting of the card edge connector desirable for use with peripherals and add-on cards. Additionally, conventional PCI card edge connectors are limited to the thickness of the card they will accommodate, whereas the disclosed invention will accommodate card edges with various thicknesses.

In view of the major drawbacks of the above card edge connectors, the inventors have made diligent studies and effort to provide a single card edge connector structure with a more universal connector with unique adjustable spring-biased pins and a cavity device to accommodate card edges or card edge adapters of various sizes in thicknesses or outer dimensions.

SUMMARY OF THE INVENTION

The main object of the present invention is to disclose a unique, adjustable card edge connector which incorporates at least a pair of movable block structures having adjustable or deflectable spring-biased PCI contact pins and a card receiving cavity defined there between to accommodate card edges or card edge adapters of various sizes in thicknesses or outer dimensions.

Another object of the present invention is to provide the at least a pair of unique movable block structures with a pair of upstanding auto thickness detection elements that are cooperatively mounted thereon and movably associated therewith for accommodating card edges of various thicknesses or dimensions.

According to the present invention, a card edge connector is disclosed incorporating a housing with a pair of upstanding side walls that are connected by a housing base portion with the at least a pair of spring members positioned between each movable block and an inner portion of the side walls and adjacent to the housing base portion. The contact pins include at least a pair of flexible or spring-like spaced-apart contact pins with an upper contact section, an intermediate contact section and a lower contact tail section defining a card receiving cavity there between. The space between the contact pins defines a cavity that initially receives card edges of various thicknesses or outer dimensions at the upper contact pin sections, then constricts through a restricted contact section (where the pair of pins are bent inward toward one another) and then finally widens near the base of the vertical movable or deflectable auto thickness detection members to a stop surface (not shown) to stop or limit the insertion of the card. The intermediate section of the pins is connected to and below the restricted contact section of the upper contact section. This intermediate section is received and extends through longitudinal pin openings in the movable block with a lower contact tail section extending there from and passes through a pair of holes in the PCB. The lower contact tail section is secured to the PCB. This tail section is connected, as by soldering, to an appropriate circuit trace on the PCB and/or in the holes of the PCB. Although the contacts herein have tail sections extending through holes in the PCB, the contact tail sections could also be right-angled for surface connection to circuit traces on the top surface of the PCB rather than extending through holes in the PCB.

In view of the aforementioned objects of the present invention, each of the at least a pair of unique movable block structures includes an upstanding movable or deflectable auto thickness detection member. The movable or deflectable auto thickness detection members are integrally secured or molded to a top surface portion of the movable block. However, the movable or deflectable auto thickness detection members can be fixedly secured mechanically in various ways, such as by different types of mechanical fasteners, such as, screws, rivets, pins, or bonding compounds, such as, adhesives, glues, to name just a few. Note that other types of fasteners could be utilized, if desired.

Each of the movable or deflectable auto thickness detection members incorporates a feature that enables automatic PCI card thickness accommodation. Note that when a PCI card of nominal thickness is inserted within the card cavity, there will be no deflection or movement of the auto thickness detection members and the movable blocks outwardly against the spring members. Note that the auto thickness detection members are adjacent to or contiguous to the deflectable contact pins. It should be brought out that when a card of nominal thickness is inserted into the card cavity, only the contact pins will move outwardly away from each other to receive the PCI card, with no effect on the auto thickness members and the movable block members. However, when PCI cards of thicknesses greater then the nominal thickness are inserted into the PCI card cavity, an inner extending or beveled edge of the auto thickness detection members will engage the PCI card edges for moving the auto thickness detection members and the movable block members outwardly against the spring members to automatically and selectively accommodate PCI cards of varying thicknesses or outer dimensions. This feature ensures that the required normal force for adequate electrical contact between the contact pins and the PCI card tabs is maintained within the desired range for any card thickness. This novel feature is achieved by a channel lock feature defined by a portion of the movable blocks and the housing base portion. The channel lock feature will now be discussed in greater detail.

The channel lock feature is defined by a cut-out upside down T-shape channel disposed along the longitudinal axis of the housing base portion and an upside down T-shape portion at the bottom of the movable blocks along a longitudinal axis thereof that is matingly received within the T-shape channel. The movable blocks T-shape portions are movable and guided along the T-shape channel of the base housing portions and into abutting engagement with the connector housing spring members to adjustably and selectively accommodate PCI cards with varying card edge thicknesses or outer dimensions when they are inserted within the above mentioned card cavity, while permitting the card edges to push against the inner extending or beveled edges of the auto thickness detection members. Also, the channel lock feature of each block member further includes a stabilizing tie rod mechanism. The stabilizing tie rod mechanism is defined by a stabilizing opening positioned in the side walls of the movable blocks for receiving stabilizing tie rod elements therein. The stabilizing tie rod elements function to stabilize the translational force generated by movement of the movable blocks as various card edge thicknesses are inserted between the inner extending or beveled edges of the auto thickness detection members. Note that how the stabilizing rods are secured to the movable blocks and the connector housing or to some other connector housing retaining structure (not shown) will not be discussed in great detail as part of the instant invention. For sake of clarity, the stabilizing rod elements have each end secured within the movable blocks stabilizing openings. The stabilizing tie rods run the length of the movable blocks and lie in a plane of the drawings with the channel lock feature being perpendicular to the housing wall.

The aforementioned objects and advantages of the present invention will be readily clarified in the description of the preferred embodiments and the enclosed drawings of the present invention.

BRIEF DESCRIPTION OF THE DRAWINGS

The present invention may be better understood, and its numerous objects, features, and advantages made apparent to those skilled in the art by referencing the accompanying drawings.

DETAILED DESCRIPTION

Reference will now be made in detail to the preferred embodiment of the invention, examples of which are illustrated in the accompanying drawings. While the invention will be described in conjunction with the accompanying drawings, it will be understood that they are not intended to limit the invention to drawings. On the contrary, the present invention is intended to cover alternatives, modifications and equivalents, which may be included within the spirit and scope of the invention as defined by the appended claim(s).

Figure 1:
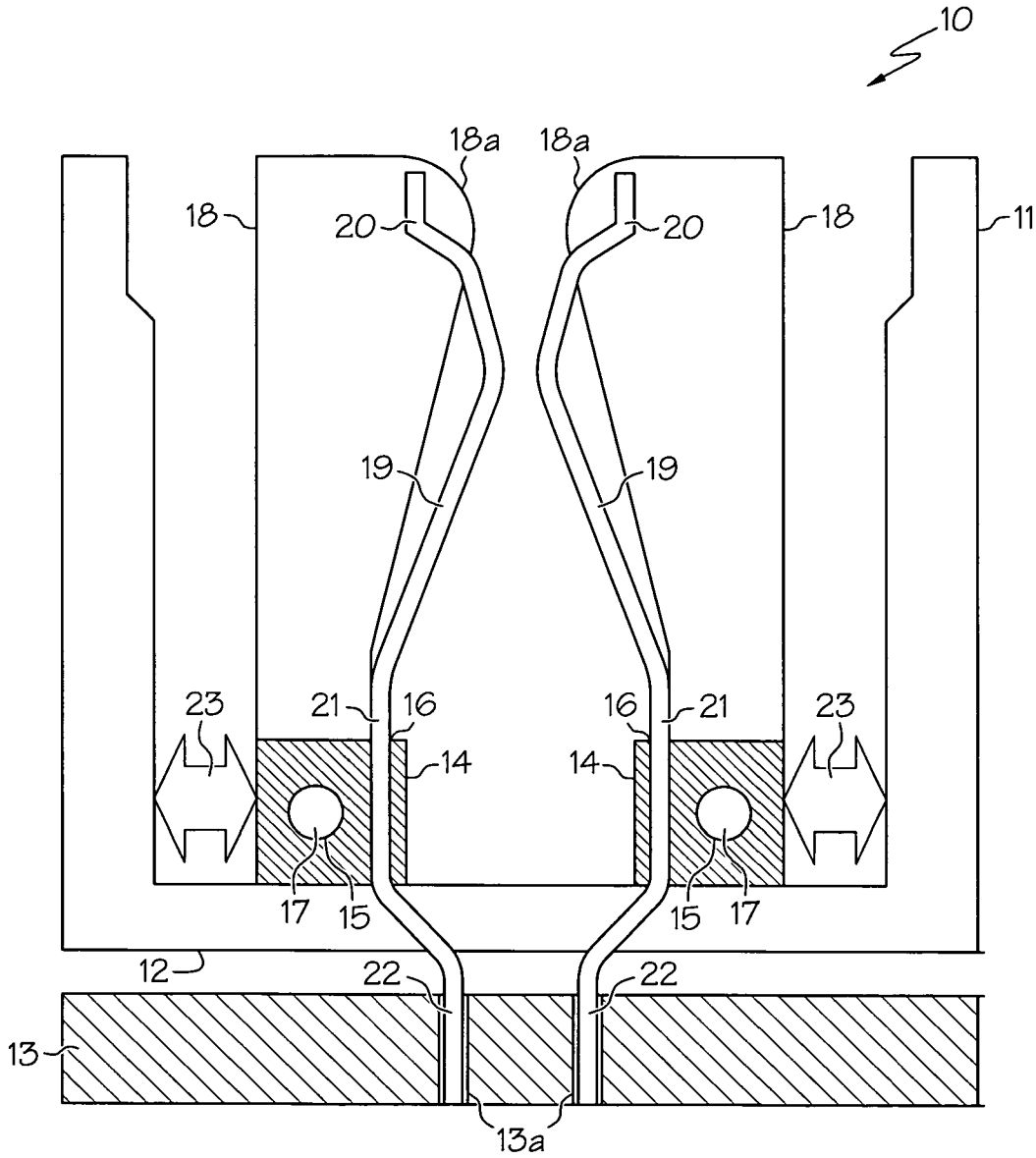
FIG. 1 illustrates a vertical sectional view of a connector housing assembly including a unique movable block structure and auto card edge thickness detection members with stabilizing tie rod elements mounted on a printed circuit board (PCB) according to the present invention.

Having reference now to the drawings, in FIG. 1 there is illustrated a sectional side view of an electrical connector housing assembly generally designated as 10 of the card edge type. The connector is typical of this type in that it includes a unitarily molded, one-piece elongated dielectric housing, generally designated 11, defining a housing base portion 12, with the base portion including a pair of openings therein (not referenced). The card edge connector housing 11 embodies an unique card edge auto thickness detection mechanism that includes at least a pair of movable block members 14 with integrally upstanding auto thickness detection members 18, each of which consists of an inner protruding beveled edge region 18*a*, and a pair of spring members 23 positioned between the movable blocks 14 and interior side wall portions of the housing 11. Also, the unique card edge auto thickness detection mechanism further includes a pair of deflectable or spring-like PCI signal contact pins 19 that extend through openings 16 of the movable block members 14 and into holes 13*a* of the PCB 13 for securing the signal contact pins 19 thereto. Note that the contact pins 19 are spaced adjacent or in close proximity to the upstanding auto thickness detection members 18.

As depicted in FIG. 1, the contact pins 19 include an upper contact section 20, an intermediate contact section 21 and a lower contact tail section 22 defining a card receiving cavity there between. The upper contact section 20 defines a cavity portion for initially receiving a PCI card with card edges of various thicknesses or outer dimensions, which then constricts through a restricted contact section (where the pair of pins are bent inward toward one another) of the cavity portion and then expands into a wider section to a stop surface (not shown) to stop or limit the insertion of the PCI card. The intermediate section 21 is integrally connected to and below the restricted contact section of the upper contact pins 20.

This intermediate section 21 is received and extends through longitudinal pin openings 16 in the movable blocks with a lower contact tail section 22 extending there from, then into the housing base portion 12 and into a pair of holes 13*a* in the PCB 13. The lower contact tail section 22 is secured to the PCB 13. This tail section 22 is connected, as by soldering, to an appropriate circuit trace on the PCB 13 and/or in the holes 13*a* of the PCB 13. Although the contact pins 19 herein have tail sections 22 extending through holes 13*a* in the PCB 13, the contact tail sections could also be right-angled for surface connection to circuit traces on the top surface of the PCB 13 rather than extending through holes 13*a* in the PCB 13. Note that an inherent flexibility of the lower contact portion between the PCB 13 and the housing base 12 allows for a movement or deflection thereof for minimizing damage to the soldering points or joints about the holes 13*a* that receive the tail section 22.

The unique card edge auto thickness detection mechanism further includes a channel lock feature defined by a portion of the movable blocks 14 and the housing base portion 12 defined by a cut-out upside down T-shape channel with an upper portion 12*a* and lower portion 12*b* disposed along the longitudinal axis of the housing base portion 12, and an upside-down T-shape portion at the bottom of the movable blocks with an upper portion 14*e* and a lower portion 14*f* along a longitudinal axis thereof that is matingly received within the T-shape channel. The movable block T-shape portions 14*e*, 14*f* are movable and guided along the T-shape channel portions 12*a*, 12*b* and into abutting engagement with the electrical connector housing spring members 23 to adjustably and selectively accommodate PCI cards with varying card edge thicknesses or outer dimensions when they are inserted within the above mentioned card cavity.

Figure 2:
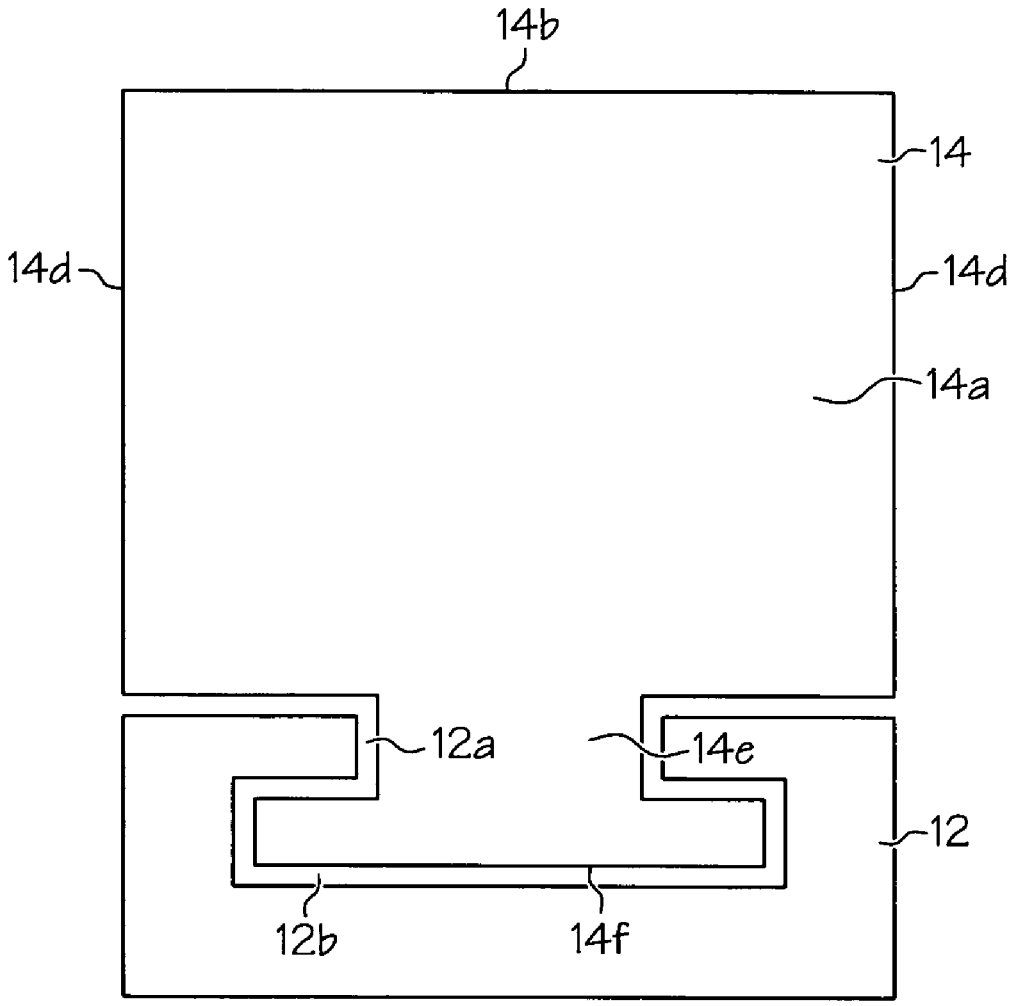
FIG. 2 illustrates a front sectional view of the unique movable block structure with a T-shape extension portion for matingly and slidably received within a T-shape channel within a connector housing base portion defining a channel lock feature according to the present invention.
Figure 3:
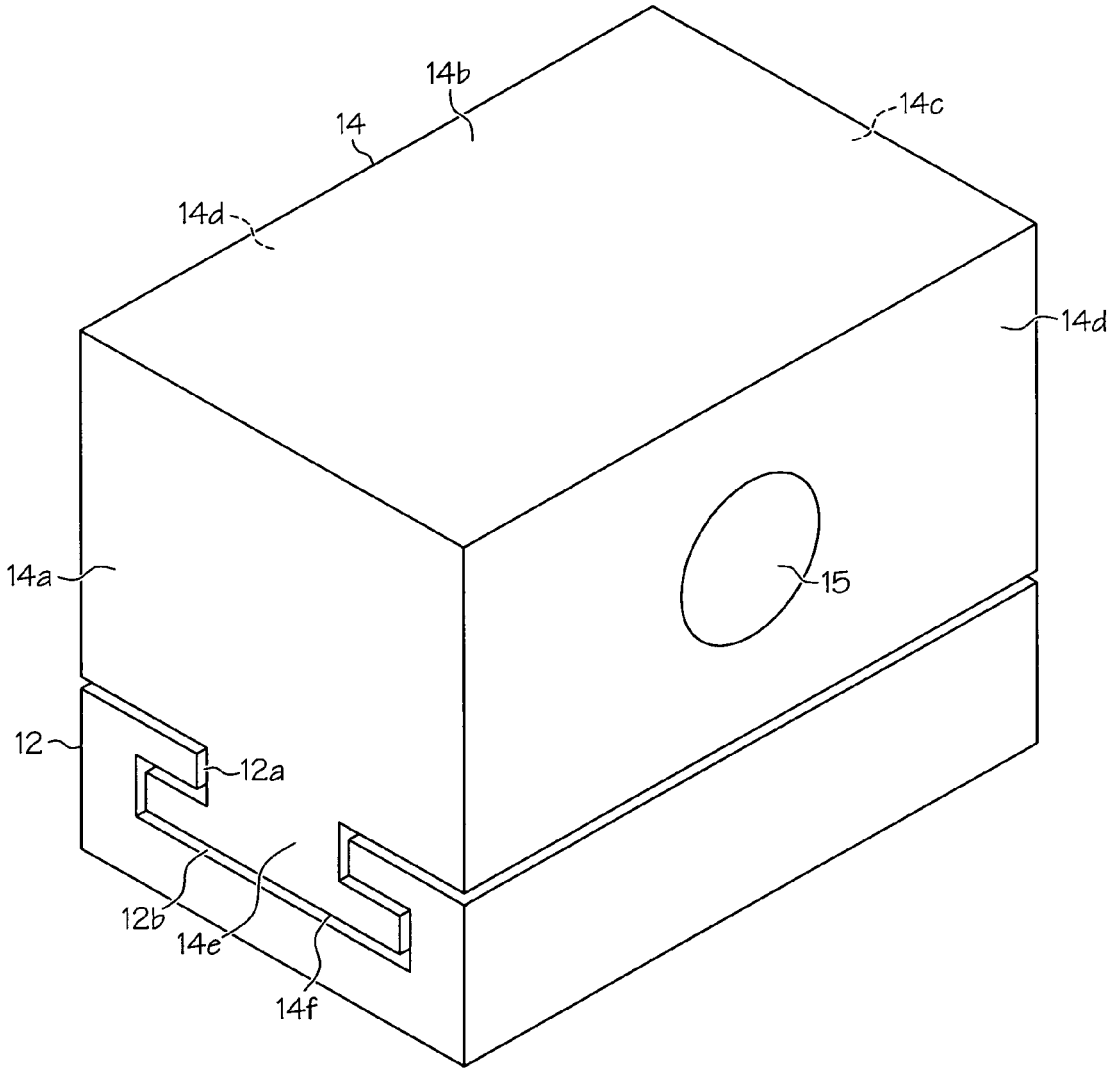
FIG. 3 illustrates an isometric view of the unique movable block structure with the T-shape extension portion for matingly and slidably received within the T-shape channel within a connector housing base portion and a stabilizing tie rod opening in a side wall of the movable block structure for receiving a stabilizing rod element, defining a channel lock feature of the present invention.
Figure 4:
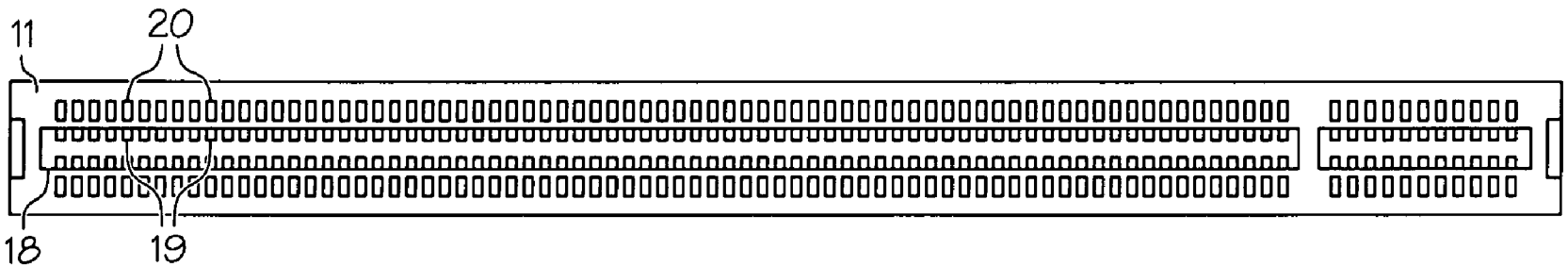
FIG. 4 illustrates a top-down view of the connector housing assembly depicting the relative position of the auto card edge thickness detection members and the pairs of contact pins running the length of the connector.

Additionally, the channel lock feature of each block member 14 further includes a stabilizing tie rod mechanism with a tie rod element 17 cooperatively associated with a tie rod hole or opening 15. As shown in FIGS. 1-3, the stabilizing openings 15 positioned in the side walls of the movable blocks 14 for receiving stabilizing tie rods 17 therein, function to stabilize a translational force generated by the movement of the movable blocks 14 as various card edge thicknesses are inserted between the inner protruding beveled edges 18*a* of the auto thickness detection members 18 when a PCI card is inserted into the card cavity. Note that how the stabilizing rods 17 are secured to the movable blocks 14 and the connector housing 11 or to some other connector housing retaining structure (not shown) will not be discussed in great detail as part of the instant invention. For a better understanding, the stabilizing rod elements 17 have each end secured within the stabilizing rod openings 15. The stabilizing rod elements 17 can be attached to the movable blocks 14 within the openings 15 in one of several ways. The simplest of which is a press fit (an interference fit) within the openings 15. They may also be secured by an appropriate adhesive, ultrasonically welded, or attached by various other securing means well known to those of ordinary skill in the art.

The operation of the card edge auto thickness detection mechanism as mentioned above is very simple and easy to accomplish. This operation is performed initially by inserting a PCI card into the cavity defined between the upper contact pin section 20 with card edges of varying thicknesses or outer dimensions, then continuing to pass through a restricted contact section (where the pair of pins are bent inward toward one another) of the cavity and then into a wider section of the cavity between the contact pins to a stop surface (not shown) to stop or limit the insertion of the PCI card. As the card edge is inserted into the card cavity, the card edge causes the contact pins 19 to deflect outwardly so that the restricted contact section of the contact pins 19 will effectively apply inward pressure on the contact pads (not shown) of the PCI card to achieve the necessary signal contact. Each of the inner protruding beveled edges 18*a* of the movable or deflectable auto thickness detection members 18 enables automatic PCI card thickness accommodation. Note that when a PCI card of nominal thickness is inserted within the above mentioned card cavity, there will be no deflection or movement of the auto thickness detection members 18 and the movable blocks 14 outwardly against the spring members 23 disposed between the movable blocks 14 and the interior housing side wall portions of housing 11 opposite the stabilizing tie rod through opening 15. Note that the auto thickness detection members are positioned adjacent to or contiguous to the deflectable contact pins 19 at the terminal ends of the connector housing 11. It should be brought out that when a card of nominal thickness is inserted into the card cavity, only the contact pins 19 will move outwardly away from each other to receive the PCI card edges, with no effect on the auto thickness members 18 and the movable block members 14. However, when PCI cards of thicknesses greater than the nominal thickness are inserted into the aforementioned PCI card cavity, the inner protruding beveled edge 18*a* on the upper end of the auto thickness detection members 18 will engage the PCI card edges for moving the auto thickness detection members 18 and the movable block members 14 outwardly against the spring members 23 to automatically and selectively accommodate the PCI cards with card edges of varying thicknesses or outer dimensions. The varying selective card edge accommodation position is achieved by the aforementioned channel lock feature defined by the movable blocks and the housing base portion for maintaining the card edges in a stable position or location. As the thicker cards are inserted, the contact pins 19 are separated as the movable blocks 14 are pushed against the springs 23. All of the contact pins 19 and the movable blocks 14 will move as a single unit because they are tied together via the stabilizing tie rods 17, which run the length of the movable blocks 14. The movable blocks 14 are prevented from rotating due to the torque exerted by the PCI card via the channel lock feature of the movable blocks 14 and the housing base portion 12 as stated above.

Another advantage of the channel lock feature is to prevent the movable blocks 14 from rotating toward the interior housing wall of housing 11 and transfer the normal force into translational motion. This feature also maintains the lower contact tail section 22 in the holes 13*a* of the PCB 13, while preventing damage to the solder points or joints about the contact tail section 22. Also, this channel lock feature prevents plastic deformation of the auto thickness detection members 18, due to the translation movement created by the movable blocks 14, the stabilizing tie rods 17, and the springs 23.

Additionally, conventional edge card connectors have been limited to the thickness of the card they will accommodate. For instance, in U.S. Pat. No. 6,790,054, it discloses that card edge connectors will accommodate edge cards ranging in thickness form 0.054 to 0.070 inches. However, the present invention will accommodate edge cards up to a thickness of 0.120 inches.

In conclusion, the auto thickness structure 14, 18 as depicted in FIGS. 1-4 is a simple and unique design that opens up more possibilities for accommodating edge cards with thicknesses greater than 0.120 inches, if desired. This is apparent to one of ordinary skill in the art, at the time the invention was made.

The foregoing descriptions of the specific embodiments of FIGS. 1-4 have been presented for purposes of illustration and description. They are not intended to be exhaustive or to limit the present invention to the precise forms disclosed, and obviously many modifications and variations are possible in the light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined as set forth in the following claim(s).

What is claimed is:

1. A method for accommodating card edges of varying thicknesses within a single card edge connector assembly, the method comprising:

providing a card edge connector housing enclosure with an open end, side walls and a housing base portion;

providing a printed circuit board with at least a pair of contact pin holes therein, at least a pair of integral deflectable contact pins disposed and secured within the contact pin holes, each of the at least a pair of contact pins having an upper contact section, an intermediate section and a lower contact tail section, the upper contact section having an open end with a restricted contact portion, the intermediate section having an outward extending portion with one end connected to the restricted contact portion and a lower end portion, and the lower contact tail section having one end connected to the lower intermediate section end portion that passes through openings in the housing base portion with the other tail section end connected and secured to the printed circuit board via the printed circuit board contact pin holes;

providing an automatic card edge thickness detection device within the card edge connector housing enclosure and spaced in close proximity to the contact pins, the automatic card edge thickness detection device includes at least a pair of movable blocks with a pair of integral upstanding auto thickness detection members, at least a pair of stabilizing tie rod members, at least a pair of spring members, the at least a pair of movable blocks having at least a pair of tie rod through openings extending between side walls of the movable blocks and a pair of contact pin through openings extending between a top surface and a bottom surface of the movable blocks, the at least a pair of spring members disposed between the movable blocks and the housing side walls, the at least a pair of stabilizing tie rod members extending into the at least a pair of tie rod openings with each end being secured to the at least a pair of movable blocks, each contact pin being inserted through the movable blocks contact pin openings with the lower intermediate section end portion disposed therein to allow the contact pins and the movable blocks to be moved together as a unit, and a channel lock feature defined by a projecting portion on a lower portion of the movable blocks that is sildably received within longitudinal channels disposed in the housing base portion; and inserting Peripheral Component Interconnect (PCI) cards with card edges of varying thicknesses between the contact pins and an inner protruding region of the upstanding auto thickness detection members so that the deflectable contact pins and the upstanding auto thickness detection members are separated selectively outwardly from one another depending on the card edge thicknesses, wherein card edges of nominal thickness will only deflect and separate outwardly the contact pins without movement of the movable blocks, whereby only selective card edge thicknesses greater than the card edge nominal thickness will cause a portion of the card edges to engage the inner protruding region on each auto thickness detection member and another portion to engage the restricted contact portion of the contact pins to allow the movable blocks projecting portions to slide along the base housing portion channels, thereby permitting the movable blocks to be moved toward the side walls against the spring members, with the stabilizing tie rod members preventing the movable blocks from rotating toward the housing side walls and transferring normal force into translational motion.

* * * * *

UNITED STATES PATENT AND TRADEMARK OFFICE

CERTIFICATE OF CORRECTION

PATENT NO. : 7,497,713 B1
APPLICATION NO. : 12/142571
DATED : March 3, 2009
INVENTOR(S) : Cary Michael Huettner et al.

It is certified that error appears in the above-identified patent and that said Letters Patent is hereby corrected as shown below:

On the Title page Item (75), "Robert Ernest Meyer, III" should be -- Robert Ernst Meyer, III --

Signed and Sealed this

Thirtieth Day of June, 2009

JOHN DOLL
*Acting Director of the United States Patent and Trademark Office*